US009799475B2

(12) United States Patent
Song

(10) Patent No.: US 9,799,475 B2
(45) Date of Patent: Oct. 24, 2017

(54) MAGNETIC LATCHING RELAY

(71) Applicant: DONGGUAN SANYOU ELECTRICAL APPLIANCES CO.,LTD, Dongguan (CN)

(72) Inventor: Chao-Yang Song, Dongguan (CN)

(73) Assignee: DONGGUAN SANYOU ELECTRICAL APPLIANCES CO., LTD, Dongguan (CN)

( * ) Notice: Subject to any disclaimer, the term of this patent is extended or adjusted under 35 U.S.C. 154(b) by 52 days.

(21) Appl. No.: 14/993,266

(22) Filed: Jan. 12, 2016

(65) Prior Publication Data

US 2017/0200579 A1 Jul. 13, 2017

(51) Int. Cl.

| | |
|---|---|
| ***H01H 51/22*** | (2006.01) |
| ***H01H 50/32*** | (2006.01) |
| ***H01H 50/36*** | (2006.01) |
| ***H01H 50/44*** | (2006.01) |

(52) U.S. Cl.

CPC ..... *H01H 50/32* (2013.01); *H01H 50/36* (2013.01); *H01H 50/44* (2013.01)

(58) Field of Classification Search

CPC ..... H01H 50/32; H01H 50/36; H01H 50/44; H01H 50/24; H01H 50/58; H01H 50/641; H01H 50/642; H01H 50/546; H01H 1/50; H01H 1/54; H01H 1/2805

See application file for complete search history.

(56) References Cited

U.S. PATENT DOCUMENTS

| | | | | |
|---|---|---|---|---|
| 7,833,034 | B2 * | 11/2010 | Connell | H01H 1/54 439/251 |
| 9,136,068 | B2 * | 9/2015 | Connell | H01H 3/001 |
| 2009/0295371 | A1 * | 12/2009 | Pontin | G01R 1/04 324/142 |
| 2013/0176017 | A1 * | 7/2013 | Connell | G01R 11/04 324/157 |

* cited by examiner

*Primary Examiner* — Bernard Rojas

(74) *Attorney, Agent, or Firm* — Ming Chow; Sinorica, LLC

(57) ABSTRACT

A magnetic latching relay includes a casing containing a coil assembly, an electrically conductive plate and a static plate. A reed assembly is installed on surfaces opposite to the electrically conductive plate and the static plate and includes a reed, a pull-to-disconnect plate installed onto the reed, and a contact formed on the pull-to-disconnect plate. The casing includes a pushing latch latched to the coil assembly. If the relay is connected, the contacts of the reed assemblies of the electrically conductive plate and the static plate will touch each other, or else the pushing latch will be moved axially along the static plate and inserted between the pull-to-disconnect plates of the reed assemblies of the electrically conductive plate and the static plate to separate the contacts, so as to monitor the connected/disconnected status of the relay. An external display device is provided for displaying the connected/disconnected status.

8 Claims, 7 Drawing Sheets

MAGNETIC LATCHING RELAY

FIELD OF THE INVENTION

The present invention relates to the field of relays, in particular to a magnetic latching relay.

BACKGROUND OF THE INVENTION

The magnetic latching relay is an electronic controller with a connected or disconnected status controlled by a magnetic force produced by a permanent magnet, and the conversion between the connected and disconnected statuses simply relies on a forward DC or reverse DC pulse voltage with a specific width to excite a coil to induce the operation of a linkage component, so as to provide the effects of automatic modulation, safety protection, and conversion in a circuit. The magnetic latching relay is used extensively in devices related to power protection, automation, sports, remote control, measurement, and communication.

The magnetic latching relay requires a specific contact pressure to assure the stability and reliability of the contact and conventional methods generally applies a bent bracket and then mechanically presses at the bending position of the bracket to actuate a product, so as to obtain a certain pressure of the bracket. However, the bracket may be distorted to change the elasticity and affect the consistency of the product due to factors such as the released stress, manufacturing process, logistics, transportation, mechanical impact, etc, or even to end up with no contact pressure and disable the product completely. A pushing latch used for pressing the bracket has a significant effect of improving the stability of the product, and the pushing latch generally cannot achieve a very good contact or detachment in a conventional snap-on design or the pushing elasticity of the bracket fails to connect or disconnect very well after a long time of use. In addition, the conventional magnetic latching relay is lack of the monitoring function and users have difficulty to effectively know whether the magnetic latching relay is connected or disconnected.

SUMMARY OF THE INVENTION

Therefore, it is a primary objective of the present invention to overcome the problems of the prior art by providing a magnetic latching relay with stable connection and disconnection and capable of monitoring the connected and disconnected status of the contact of the relay.

To achieve the aforementioned objective, the present invention provides a magnetic latching relay, comprising: a casing, including a coil assembly, an electrically conductive plate and a static plate installed therein, and both opposite surfaces of the electrically conductive plate and the static plate having a reed assembly, and the reed assembly including a reed, a pull-to-disconnect plate installed onto the reed, and a contact installed onto the pull-to-disconnect plate, characterized in that the casing includes a pushing latch installed therein and latched to a coil assembly, such that when the relay is connected, the contact of the reed assembly of the electrically conductive plate and the contact of the reed assembly of the static plate are in contact with each other; and when the relay is disconnected, the pushing latch is moved in the axial direction of the static plate and inserted between the pull-to-disconnect plate of the reed assembly of the electrically conductive plate and the pull-to-disconnect plate of the reed assembly of the static plate, and the contact of the reed assembly of the electrically conductive plate is separated from the contact of the reed assembly of the static plate.

The casing includes a position restoring bracket installed onto the static plate and acting on the pushing latch.

The pushing latch includes a reed assembly provided for inserting into a tapered end between the reed assembly of the electrically conductive plate and the reed assembly of the static plate.

The pushing latch includes a plastic casing and a reinforcing plate installed in the plastic casing, and the tapered end is disposed on the plastic casing.

The casing further includes a monitor switch fixed and installed therein, and the monitor switch includes a monitor dynamic plate, a monitor dynamic point, a monitor static plate and a monitor static point, and the monitor dynamic point is installed on the monitor dynamic plate, and the monitor static point is installed on the monitor static plate; when the relay is connected, the monitor dynamic point and the monitor static point are in contact with each other; when the pushing latch is inserted between the electrically conductive plate and the static plate, the pushing latch push away the monitor dynamic plate to separate the monitor dynamic point from the monitor static point.

The monitor dynamic plate and the monitor static plate are bent metal brackets, and the monitor dynamic point and the monitor static point are metal contacts.

The coil assembly includes a yoke, a ferrite core, a stop nail, a terminal pin, a magnet, an armature and a framework, and a coil is wound around an external wall of the framework, and the framework is disposed in the yoke, and the ferrite core is installed at the front of the yoke and mounted into the framework, and the stop nail is installed at the rear of the yoke, and the magnet is installed inside the front of the framework, and the terminal pin is installed at the rear of the framework, and the armature is movably installed in the framework, and a front end of the armature is exposed from the framework and pointed towards the stop nail, and the pushing latch is snapped to the armature exposed from the framework.

The armature includes a circular slot formed at the circular front end of the armature, and the pushing latch has a notch formed thereon and latched to the circular slot of the armature.

The magnetic latching relay of the present invention can be connected and disconnected with a high reliability, and the pushing latch is provided for the connection and disconnection effectively, and the monitor switch is added and connected to the external display device to allow users to monitor the connected and disconnected statuses of the contact, and the external display device displays the connected or disconnected status of the relay to assure the safety of the operator during the installation, maintenance, and repair processes of an electric meter.

DESCRIPTION OF THE PREFERRED EMBODIMENTS

Figure 1:
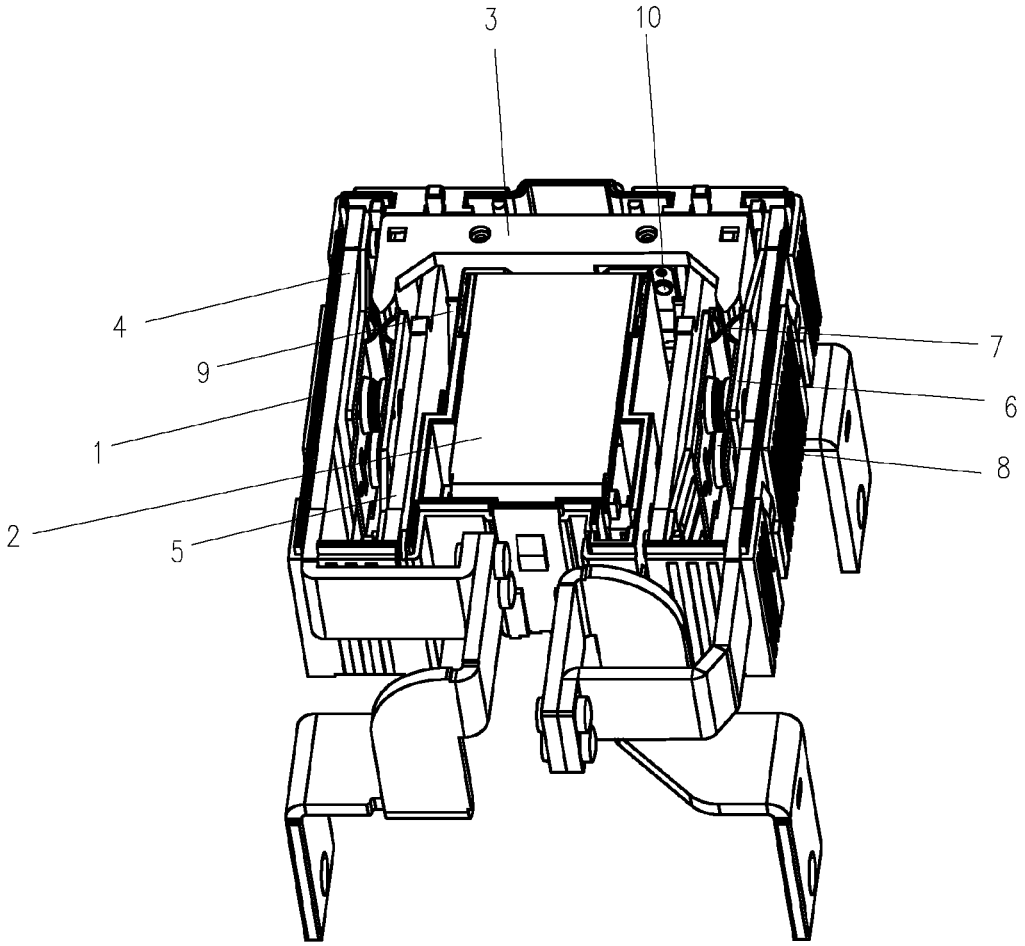
FIG. 1 is a perspective view of the present invention.
Figure 2:
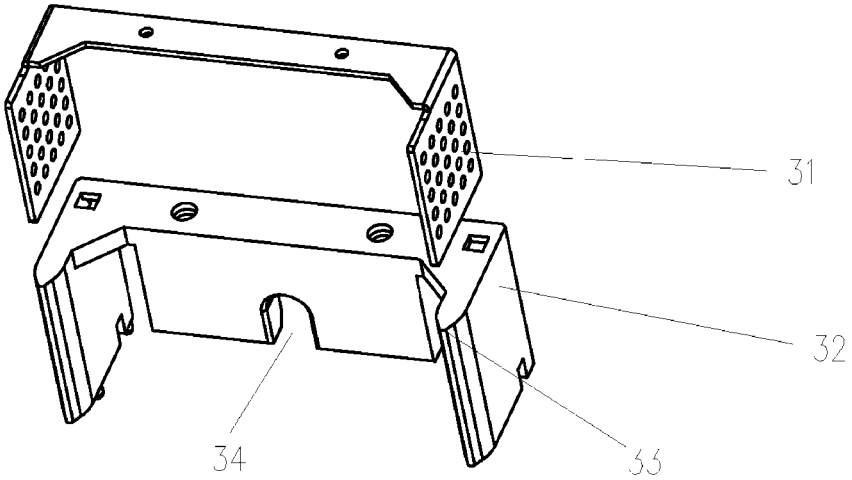
FIG. 2 is an exploded view of a pushing latch of the present invention.
Figure 3:
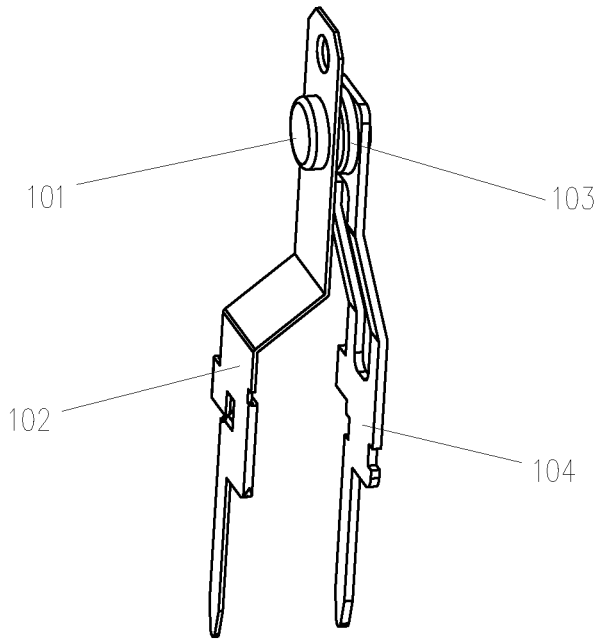
FIG. 3 is a perspective view of a monitor switch of the present invention.

The aforementioned and other objectives and advantages of the present invention will become clearer in light of the following detailed description of an illustrative embodiment of this invention described in connection with the drawings.

With reference to FIGS. 1 to 5 for a magnetic latching relay of the present invention, the magnetic latching relay comprises a casing 1, including a coil assembly 2, an electrically conductive plate 4 and a static plate 5, and a reed assembly being installed on surfaces precisely opposite to the electrically conductive plate 4 and the static plate 5, and the reed assembly including a reed 6, a pull-to-disconnect plate 7 installed onto the reed 6, and a contact 8 installed onto the pull-to-disconnect plate 7, wherein the pull-to-disconnect plate 7 is riveted to the reed 6, and the contact 8 is riveted to the pull-to-disconnect plate 7 and the reed 6, and the casing 1 contains a pushing latch 3 latched to the coil assembly 2. When the relay is connected, the contact of the reed assembly of the electrically conductive plate 4 touches the contact of the reed assembly of the static plate 5. When the relay is disconnected, the pushing latch is moved along an axial direction of the static plate and inserted between the pull-to-disconnect plate of the reed assembly of the electrically conductive plate and the pull-to-disconnect plate of the reed assembly of the static plate, and the contact of the reed assembly of the electrically conductive plate is separated from the contact of the reed assembly of the static plate. The pushing latch is made of an insulating material, which is a prior art, and thus will not be described in details. As to the reed assembly installed onto the electrically conductive plate, the reed is riveted to the electrically conductive plate. As to the reed assembly installed onto the static plate, the reed is riveted onto the static plate. Both of the electrically conductive plate and the static plate have a reed assembly installed thereon to form Z-shaped structure. The pull-to-disconnect plate has a bent protrusion to facilitate spreading open or latching the pushing latch, which is a prior art and will not be described in details. The moving path of the pushing latch is along the axial direction of the static plate or the axial direction of the pull-to-disconnect plate, so that after the pull-to-disconnect plate is spread open, it can resume its original position effectively, and assure the reliability of the connection between the contacts of the electrically conductive plate and the static plate as well as the reliability of the connection of the relay.

The casing 1 contains a position restoring bracket 9 installed therein and on the static plate 5 and acting on the pushing latch 3. When the pushing latch 3 moves towards the pull-to-disconnect plate 7, the pushing latch 3 will be blocked by the position restoring bracket 9 and will keep moving with the pushing latch 3, and the position restoring bracket 9 is compressed and deformed by the pushing latch 3, until the pushing latch 3 is inserted between the pull-to-disconnect plates of the electrically conductive plate 4 and the static plate 5 to disconnect the relay. Now, the position restoring bracket is compressed and deformed to the greatest extent by the pushing latch. When the relay is connected again, the pushing latch is withdrawn to resume its original position easily by the resilience of the restoring bracket.

The pushing latch 3 includes a tapered end 33 provided for inserting between the reed assemblies of the electrically conductive plate 4 and the static plate 5, so that the tapered end can be inserted between the pull-to-disconnect plates of the electrically conductive plate and the static plate more easily. The pushing latch 3 includes a plastic casing 32 and a reinforcing plate 31 installed in the plastic casing 32, and the tapered end 33 is disposed on the plastic casing 32, and the reinforcing plate may be formed directly in the plastic casing during the manufacturing process.

In addition, the casing 1 further includes a monitor switch 10 fixed and installed therein, and the monitor switch 10 includes a monitor dynamic plate 102, a monitor dynamic point 101, a monitor static plate 103 and a monitor static point 104, and the monitor dynamic point 101 is disposed on the monitor dynamic plate 102, and the monitor static point 103 is disposed on the monitor static plate 104. When the relay is connected, the monitor dynamic point 101 and the monitor static point 103 touch with each other. When the pushing latch 3 is inserted between the electrically conductive plate 4 and the static plate 5 to disconnect the relay, the pushing latch pushes the monitor dynamic plate at the same time to separate the monitor dynamic point from the monitor static point. Both of the monitor dynamic plate and the monitor static plate are bent metal bracket, and both of the monitor dynamic point and the monitor static point are metal contacts capable for conducting electricity. After the pushing latch pushes away the monitor dynamic plate and returns, the monitor dynamic plate can bound back automatically, so that the monitor dynamic point touches the monitor static point again. The monitor switch is connected to an external display device which is used to monitor the connected/disconnected status of the relay. According the connection or disconnection of the monitor dynamic point and the monitor static point, the connected/disconnected status of the relay is monitored. Specifically, when the monitor dynamic point and the monitor static point are contacted and connected, the relay is situated in a connected status, and the external display device shows that the relay is currently situated in a connected status; and when the monitor dynamic plate is pushed away by the pushing latch, the monitor dynamic point and the monitor static point are separated from each other, and the relay is situated in a disconnected status, and the external display device shows that shows that the relay is currently situated in a disconnected status. Therefore, maintenance personnel can check on their work easily.

In addition, the coil assembly 2 includes a yoke 21, a ferrite core 22, a stop nail 23, a terminal pin 24, a magnet 25, an armature 26 and a framework 27, and a coil 28 is wound around an external wall of the framework 27, and the framework 27 is installed in the yoke 21, and the ferrite core 22 is installed at the front of the yoke 21 and mounted into the framework 27, and the stop nail 23 is installed at the rear of the yoke 21, and the magnet 25 is installed in the front of the framework 27, and the terminal pin 24 is installed at the rear of the framework 27, and an armature 26 is movably installed in the framework 27 and the front end of the armature 26 is exposed from the framework 27 and pointed towards the stop nail 23, and the pushing latch 3 is latched to the armature 26 exposed from the framework 27. A circular slot 264 is formed at a front end of the armature 26, and a notch 34 is formed on the pushing latch 3, and the notch 34 of the pushing latch 3 is latched to the circular slot 261 of the armature 26. The pushing latch and the armature are movably latched with each other. A forward or reverse current is passed into the coil assembly to drive the armature to move in a direction towards the ferrite core or away from the ferrite core, so as to drive the movement of the pushing latch.

In the present invention, the monitor switch is connected to an external display device. In FIG. 1, when the relay is situated in a connected status and the position of the pushing latch is assumed to be the initial position, the contact of the electrically conductive plate is attached and contacted with the contact of the static plate, and the pull-to-disconnect plate of the electrically conductive plate approaches the pull-to-disconnect plate of the static plate. In the meantime, the monitor dynamic point and the monitor static point are contacted and attached with each other.

Figure 4:
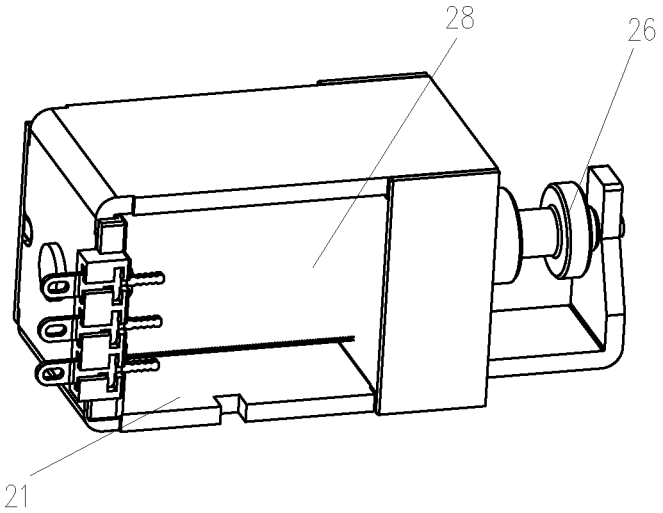
FIG. 4 is a perspective view of a coil assembly of the present invention.
Figure 5:
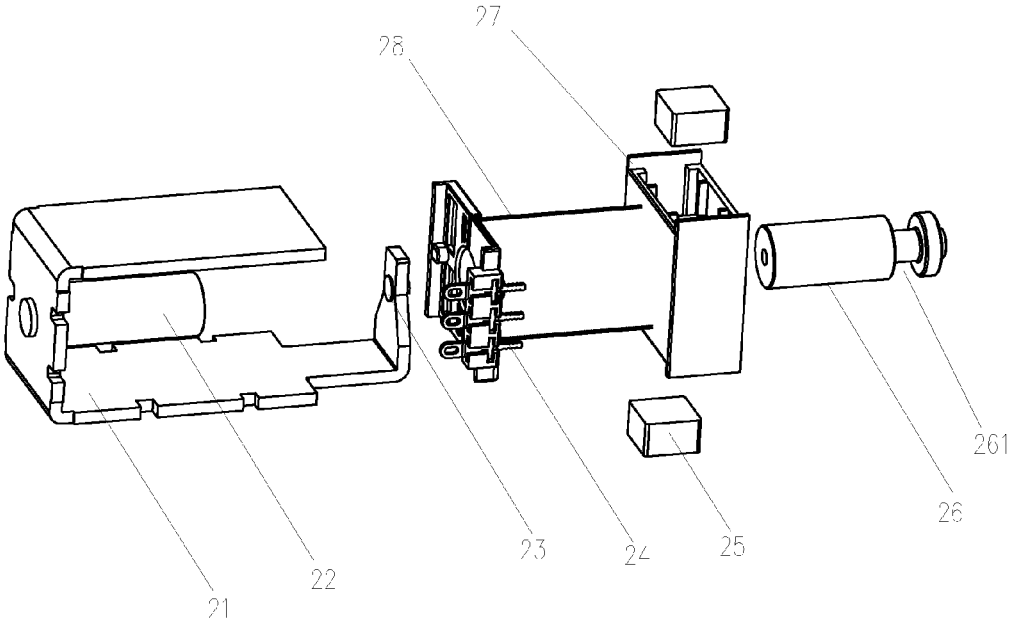
FIG. 5 is an exploded view of a coil assembly of the present invention.
Figure 7:
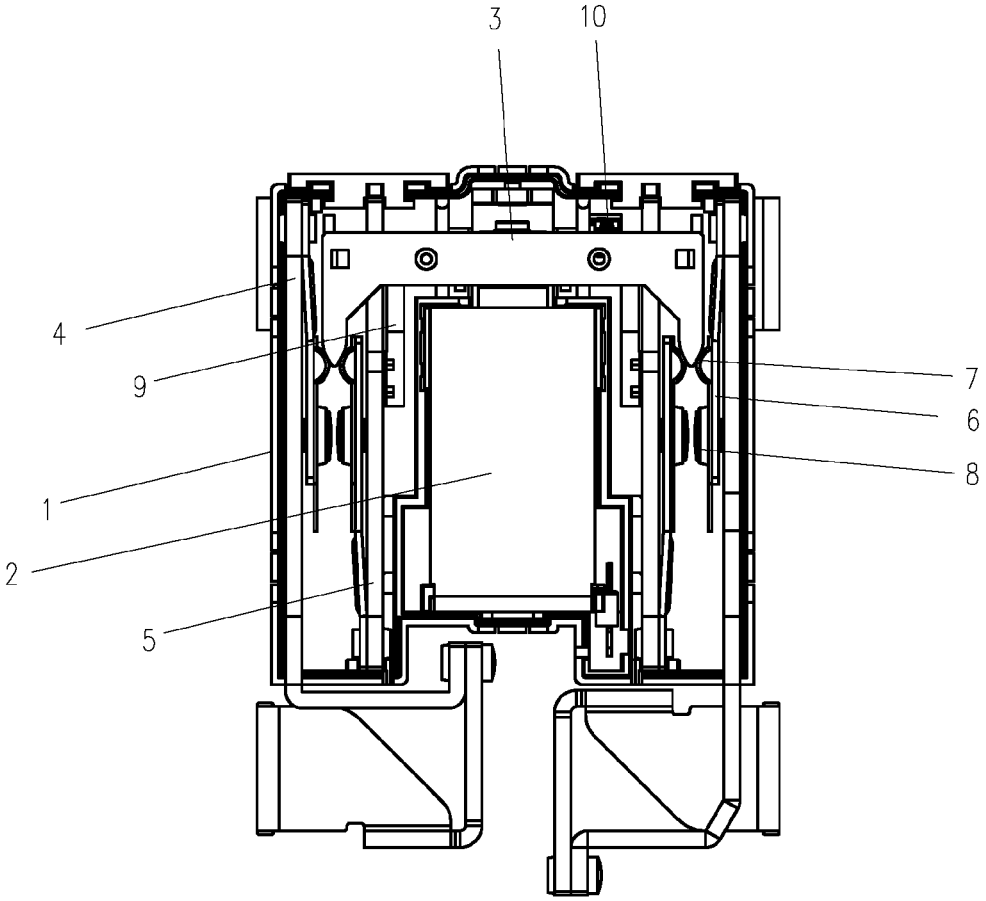
FIG. 7 is a schematic view showing a disconnected status of the present invention.

In FIGS. 4, 5 and 7, when the relay switches its connected status to the disconnected status, electric power is passed to the coil assembly 2, and the armature 26 is moved towards the ferrite core 22. In the process of moving the armature, the pushing latch 3 is driven to move towards the pull-to-disconnect plate. In the process of moving the pushing latch 3 towards the pull-to-disconnect plate, the restoring bracket 9 is compressed and keeps moving with the pushing latch, and finally the tapered end of the pushing latch 3 is inserted between the pull-to-disconnect plate of the electrically conductive plate and the pull-to-disconnect plate of the static plate to separate the two pull-to-disconnect plates, so that the reed of the electrically conductive plate and the reed of the static plate are compressed to move away from each other, and the contact of the electrically conductive plate is separated from the contact of the static plate. In the process of moving the pushing latch towards the pull-to-disconnect plate, the monitor dynamic plate 102 of the monitor switch 10 is pushed away at the same time, so that the monitor dynamic point 101 of the monitor dynamic plate 102 is separated from the monitor static point 103 of the monitor static plate 104 to achieve the effect of monitoring the disconnection of the relay. When the monitor dynamic point and the monitor static point are separated from each other, the external display device shows that the relay is currently situated in a disconnected status.

Figure 6:
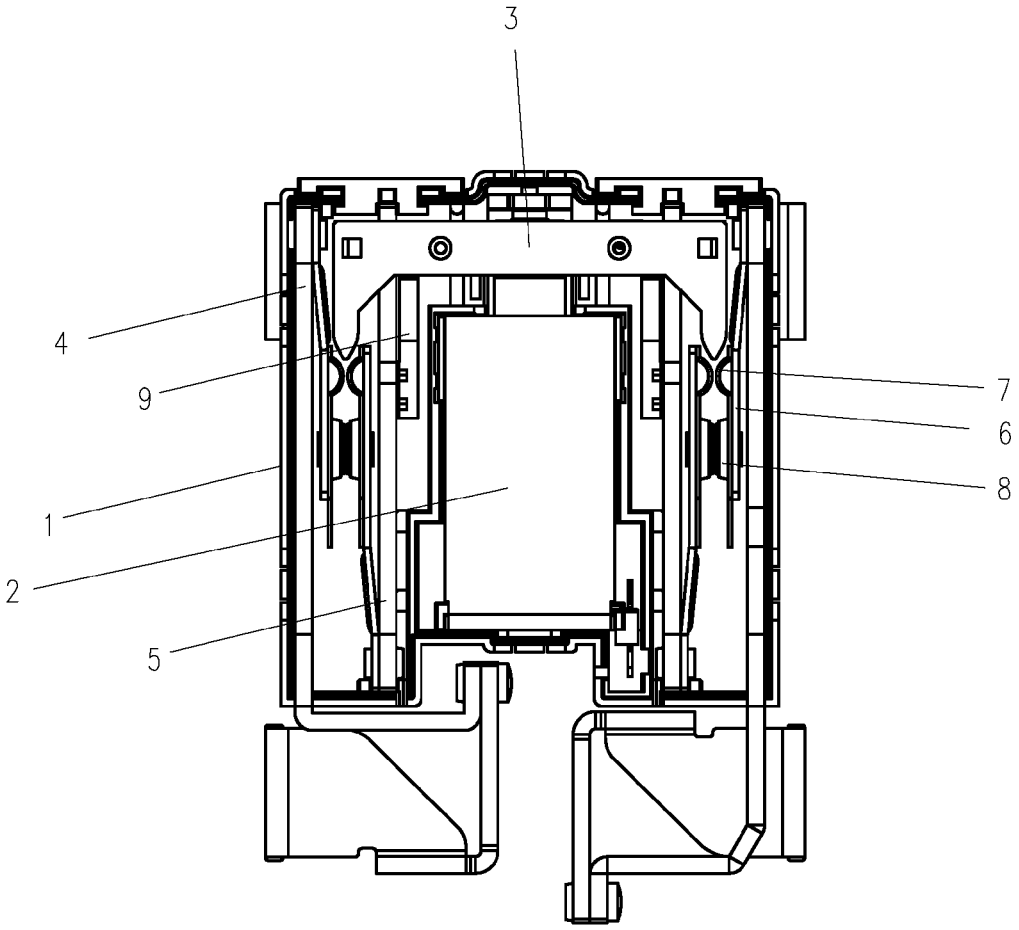
FIG. 6 is a schematic view showing a connected status of the present invention.

In FIGS. 4, 5 and 6, when the relay switches from its disconnected status to the connected status, electric power is passed to the coil assembly 2, and the armature 26 is moved in a direction away from the ferrite core 22 under the effect of the resilience of the position restoring bracket 9. In other words, the armature 26 is moved away from the pull-to-disconnect plate while driving the pushing latch 3 to move in a direction away from the pull-to-disconnect plate. While keeping moving with the pushing latch, the tapered end of the pushing latch 3 is moved away from the pull-to-disconnect plate 7. With the elastic restoring force of the reed of the electrically conductive plate and the reed of the static plate, the contact of electrically conductive plate and the contact of the static plate touch each other again. In the meantime, the pushing latch 3 is moved away from the monitor dynamic plate 102 of the monitor switch 10, and the monitor dynamic plate 102 resumes its initial position, and the monitor dynamic point 101 and the monitor static point 103 switch their disconnected status to connected status and touch with each other again, so as to achieve the effect of monitoring the connection of the relay. When the monitor dynamic point and the monitor static point touch each other, the external display device shows that the relay is currently situated in a connected status.

When the relay is disconnected or connected, we just need to pass a forward/reverse current to the coil assembly and use the forward DC or reverse DC pulse voltage to excite the coil to drive the armature to move towards the ferrite core or away from the ferrite core in order to move the pushing latch in different directions.

While the invention has been described by means of specific embodiments, numerous modifications and variations could be made thereto by those skilled in the art without departing from the scope and spirit of the invention set forth in the claims.

What is claimed is:

1. A magnetic latching relay comprising:

a casing;

a coil assembly;

a pushing latch;

an electrically conductive plate;

a static plate;

a first reed assembly;

a second reed assembly;

the coil assembly, the pushing latch, the electrically conductive plate, the static plate, the first reed assembly and the second reed assembly being mounted in the casing;

the electrically conductive plate comprising a first surface and a first axial direction;

the first reed assembly being disposed on the first surface;

the static plate comprising a second surface and a second axial direction;

the second reed assembly being disposed on the second surface;

the first axial direction and the second axial direction being parallel to each other;

the first surface and the second surface being located opposite to each other;

the first reed assembly and the second reed assembly being located opposite to each other;

the first reed assembly comprising a first reed, a first pull-to-disconnect plate and a first contact;

the first reed being disposed on the first surface;

the first pull-to-disconnect plate being riveted to the first reed;

the first contact being riveted to the first reed and the first pull-to-disconnect plate;

the second reed assembly comprising a second reed, a second pull-to-disconnect plate and a second contact;

the second reed being disposed on the second surface;

the second pull-to-disconnect plate being riveted to the second reed;

the second contact being riveted to the second reed and the second pull-to-disconnect plate;

the pushing latch being latched to the coil assembly;

the magnetic latching relay being in a connected status in response to the first contact and the second contact being in contact with each other;

the magnetic latching relay being in a disconnected status in response to the first contact and the second contact being separate from each other; and the first contact and the second contact being separated from each other in response to the pushing latch being moved along the first axial direction and the second axial direction and inserted in between the first pull-to-disconnect plate and the second pull-to-disconnect plate.

2. The magnetic latching relay according to claim 1 comprising:

a position restoring bracket;

the position restoring bracket being disposed on the static plate; and the position restoring bracket being biased against the pushing latch in response to the pushing latch being moved along the first axial direction and the second axial direction and inserted in between the first pull-to-disconnect plate and the second pull-to-disconnect plate.

3. The magnetic latching relay according to claim 1 comprising:

the pushing latch comprising a tapered end; and the tapered end being inserted in between the first pull-to-disconnect plate and the second pull-to-disconnect plate in response to the pushing latch being moved along the first axial direction and the second axial direction and inserted in between the first pull-to-disconnect plate and the second pull-to-disconnect plate.

4. The magnetic latching relay according to claim 3 comprising:

the pushing latch comprising a plastic casing and a reinforcing plate;

the reinforcing plate being mounted in the plastic casing; and the tapered end being disposed on the plastic casing.

5. The magnetic latching relay according to any one of claims 1 to 4 comprising:

a monitor switch;

the monitor switch being mounted in the casing;

the monitor switch comprising a monitor dynamic plate, a monitor dynamic point, a monitor static plate and a monitor static point;

the monitor dynamic point being disposed on the monitor dynamic plate;

the monitor static point being disposed on the monitor static plate;

the monitor dynamic point and the monitor static point being in contact with each other in response to the magnetic latching relay being in the connected status; and the pushing latch pushing away the monitor dynamic plate so as to separate the monitor dynamic point from the monitor static point in response to the pushing latch being moved along the first axial direction and the second axial direction and inserted in between the first pull-to-disconnect plate and the second pull-to-disconnect plate.

6. The magnetic latching relay according to claim 5 comprising:

the monitor dynamic plate and the monitor static plate each being a bent metal bracket; and the monitor dynamic point and the monitor static point each being a metal contact.

7. The magnetic latching relay according to claim 6 comprising:

the coil assembly comprising a yoke, a ferrite core, a stop nail, a terminal pin, a magnet, an armature, a framework and a coil;

the coil being wound around an external wall of the framework;

the framework being disposed in the yoke;

the ferrite core being installed at a front of the yoke and mounted into the framework;

the stop nail being installed at a rear of the yoke;

the magnet being installed inside a front of the framework;

the terminal pin being installed at a rear of the framework;

the armature being movably installed in the framework;

a circular front end of the armature being exposed from the framework and pointed towards the stop nail; and the pushing latch being connected to the circular front end of the armature.

8. The magnetic latching relay according to claim 7 comprising:

the armature comprising a circular slot;

the circular slot being formed at the circular front end of the armature;

the pushing latch comprising a notch; and the notch being latched to the circular slot.

* * * * *